United States Patent [19]

Pedrazzini

[11] 4,293,349

[45] Oct. 6, 1981

[54] PROTECTIVE COMPOSITIONS FOR STEEL SURFACES AND THE PROCESS FOR THEIR PREPARATION

[75] Inventor: Giuseppe Pedrazzini, Milan, Italy

[73] Assignee: Parker Italiana S.a.s., Milan, Italy

[21] Appl. No.: 131,112

[22] Filed: Mar. 17, 1980

[30] Foreign Application Priority Data

Mar. 16, 1979 [IT] Italy ..... 21079 A/79

[51] Int. Cl.[3] ..... C23F 7/10

[52] U.S. Cl. ..... 148/6.15 R; 148/6.15 Z; 148/31.5

[58] Field of Search ..... 148/6.15 Z, 6.15 R, 148/31.5

[56] References Cited

U.S. PATENT DOCUMENTS

| | | | |
|---|---|---|---|
| 2,502,441 | 4/1950 | Dodd | 148/6.15 R |
| 2,854,368 | 9/1958 | Shreir | 148/6.15 R |
| 2,863,793 | 12/1958 | Cerma | 148/6.15 Z |
| 4,017,334 | 4/1977 | Matsushima et al. | 148/6.15 R |

FOREIGN PATENT DOCUMENTS

| | | | |
|---|---|---|---|
| 259599 | 4/1970 | U.S.S.R. | 148/6.15 Z |

*Primary Examiner*—Ralph S. Kendall

*Attorney, Agent, or Firm*—Morgan, Finnegan, Pine, Foley & Lee

[57] ABSTRACT

The invention refers to new compositions for protecting steel surfaces from the oxidizing action of atmosphere.

The essential components are: glucosides of pyrogallic and/or allagic acid of molecular weight between 270 and 1200; phosphoric acid, phosphates of bivalent transition metals such as Zn and Mn and nitrates of bivalent metals such as Zn and Mn.

7 Claims, 8 Drawing Figures

PROTECTIVE COMPOSITIONS FOR STEEL SURFACES AND THE PROCESS FOR THEIR PREPARATION

Figure 1:
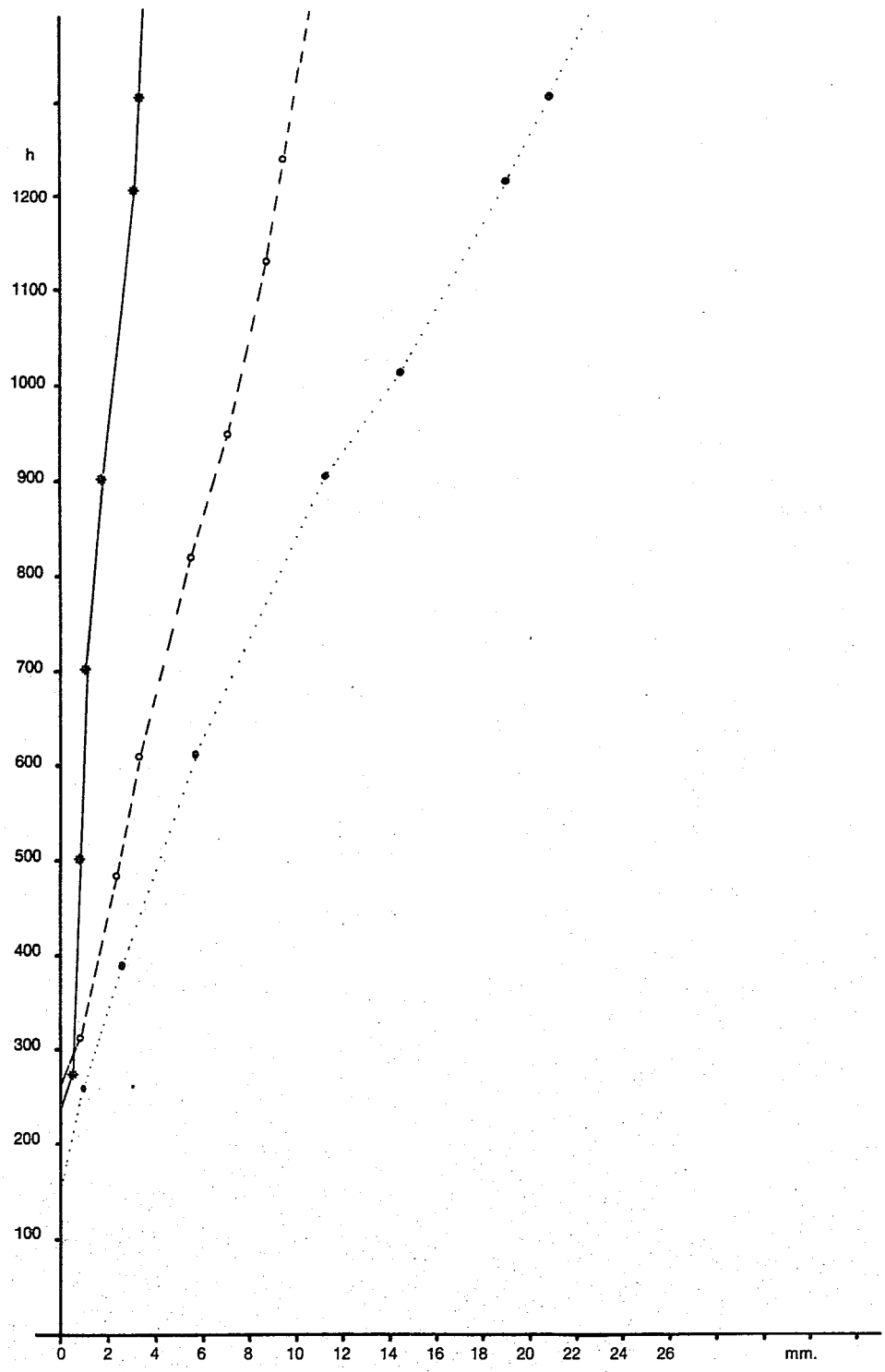

This invention relates to new compositions for protecting steel surfaces from the oxidising action of the atmosphere, and the process for their preparation.

The invention further relates to steel manufactured articles comprising an antioxidising protective layer of new composition, either as a final outer layer or as an intermediate layer below the paint, and the method for protecting the steel from atmospheric corrosion by means of the new protective layer.

Various methods are at present used for protecting steel surfaces from the corrosive action of the atmosphere and, in the case of painted metal surfaces, to prevent oxidation of the metal surface causing the overlying paint layer to separate and rapidly flake. The method most widely used and that which has given the best results in this field up to the present time is undoubtedly the phosphating method. This method consists essentially of treating the oxidised or unoxidised steel surfaces with aqueous solutions containing phosphoric acid.

The phosphoric acid attacks the steel to form Fe phosphates. Whereas primary iron phosphate is soluble and secondary iron phosphate is slightly soluble, tertiary iron phosphate is totally insoluble. The main purpose of phosphating is therefore to form a surface layer of insoluble tertiary iron phosphate, which protects the underlying metal from any further attack by atmospheric agents. In this respect, during the attack by the phosphating solution, the pH rises due to the reduction in the hydrogen ion concentration in the limiting layer, and the insoluble tertiary phosphates consequently precipitate.

The phosphate layer formed in the reaction between the phosphating solution and the steel adheres closely to the treated surface, and is characterised by high resistance to electronic conduction, because of which it protects the underlying metal from further oxidation, and prevents incoherence and flaking of pre-existing products of corrosion.

The phosphating solutions used are rather complicated in that in addition to phosphoric acid and possibly phosphates, they also comprise surface active agents, accelerators, inhibitors for inhibiting acid attack of zero valent metal, solvents, antioxidants etc., and can be applied to any type of article on which they form a very thin adhering film.

The critical aspect of the phosphating process is the phosphoric acid concentration in the phosphating solution. In this respect, if the phosphoric acid is not completely consumed by its reaction with the oxides present on the treated surface and by the surface reaction with the iron, it presents, even if present in only small concentrations, a strongly acid reaction to the subsequently applied layers such as the oil, wax and paint, and consequently can lead to negative reactions in these layers and in the finishing layer, which alter and disintegrate them.

However as it is obviously very difficult to exactly calculated the phosphoric acid necessary, in that the useful quantity also depends on the type of iron oxide formed on the surface, and as an acid defect leads to an unsatisfactory phosphated layer, the treatment is generally carried out with an excess of acid, and the phosphated article is washed with an abundant amount of water before applying the finishing layer. This procedure however is not free from drawbacks, in that the protective layer of tertiary iron phosphates is very thin and poorly supports the water wash, and in general becomes rehydrolysed with the formation of new incoherent oxide. To overcome the drawbacks and limitations of phosphating, for some years steel surface treatments have been employed which use compositions based on tannic acid derivitives of very high molecular weight which instead of eliminating the rust existing on the steel surfaces form a continuous covering film over the rust. This film is constituted by the product of reaction between the tannic acids and the iron, and is a chelate of variable composition anchored to the support.

The drawbacks inherent with this type of surface protection derive mainly from the fact that, as stated, the iron oxide layer which may be present on the steel surface remains imprisoned between the support and the protective layer without being eliminated, and can give rise to separation of the chelate layer, especially as a result of its different anisotropic coefficient of expansion from that of the support and protective layer.

Morever, the ion exchange reactions $Fe^{++} \rightleftarrows Fe^{+++}$ continue under the organic coating cover in the layer of non-eliminated Fe oxides, with a consequent variation in the composition of the oxidised layer. Overall, there is therefore an instability of the system, in which tensions are created which affect the organic chelate layer and lead to discontinuities. Difficulties are also encountered in this method due to the pH of the tannic acid-based compositions applied, this pH often not being sufficiently low to provide an initial rate of attack which is significant.

A new method has now been found, and forms the subject matter of the present invention, for protecting oxidised or unoxidised steel surfaces, which has none of the drawbacks of the methods of the known art, and which also ensures a degree of metal protection never attained up to the present time.

The new method is characterised by the use of mixed inorganic/ organic compositions in which each component performs a specific function, and is present in a quantity which is critical for the equilibrium of the system. If the components are used outside the critical limits or unscheduled components are added, the system becomes blocked and does not function.

The essential components of the new compositions according to the invention are the following:

- pryogallic acid glucosides and/or ellagic acid glucosides having a molecular weight of between 270 and 1200
- phosphoric acid
- phosphates of bivalent transition metals such as Zn or Mn
- Zn nitrate or Mn nitrate.

The possibility of constructing such a mixed system was unforeseeable previously, in that as the organic component is an ester, this is sensitive to the hydrolysing action of phosphoric acid.

In reality, as will be apparent hereinafter, the hydrolysing and thus inactivating action of the phosphoric acid occurs only if the system deviates from the precisely defined limits of its equilibrium, for one of the reasons stated hereinafter.

Furthermore, it was in no way foreseeable that a system constituted by phosphating components present in proportions which would not be effective in a phosphating process, and an organic component absolutely ineffective if used alone because of its low molecular weight, would be able to provide an anticorrosive action considerably superior to that obtainable by phosphating or by the known tannin treatments.

The purpose of the pyrogallic acid glucosides and/or ellagic acid glucosides, which represent the main component of the new antirust system, is to form with the surface iron a layer of insoluble chelate which covers the treated surface, so protecting it from attack by atmospheric agents.

However, these glucosides are weak acids which give the treating solution and the treated surface a pH of around 3, which is too high to give the necessary hydrogen ion concentration for initiating the attack of the metal surface or of the surface oxide layer, and to make it proceed at a sensible rate.

The function of providing the organic chelating compound with $Fe^{++} \rightleftarrows Fe^{+++}$ ions, so raising the kinetics of the coordination process to a value high enough to be industrially significant, is performed in the new system according to the invention by phophoric acid, which brings to the treated surface a quantity of $H^+$ ions sufficient to allow attack of the iron oxides present on the surface, essentially according to the equation $$Fe(OH)_3 + 3H^+ \rightarrow Fe_{+++} + 3H_2O$$

The attack of the unoxidised metal surface (zerovalent metal) always carried out by the phosphoric acid, is favoured by the nitrate ($Zn(NO_3)_2$ or $Mn(NO_3)_2$), which has the function of an oxidant/ accelerator in the phosphating process.

$Fe^{++} \rightleftarrows Fe^{+++}$ ions are also released in this case, and feed the organic chelate formation process.

Finally, the phosphate of formula $Me(H_2PO_4)_2$, in which Me is a bivalent transition metal, and which is another essential component of the new antirust compositions, gives rise spontaneously, on contact with the metal surface, to the following reactions.

$$Me(H_2PO_4)_2 \rightleftarrows Me\ HPO_4 + H_3PO_4$$

$$3\ Me\ HPO_4 \rightleftarrows Me_3\ (PO_4)_2 + H_3PO_4$$

in which phosphoric acid is produced at equilibrium, and insoluble tertiary phosphates are formed.

This component becomes disposed in the system in an equilibrium state by which it spontaneously provides phosphoric acid to the extent in which it is removed by the reaction with the iron oxides. This means that initially only a limited quantity of phosphoric acid need be included, and that during treatment only a limited quantity of acid is present at any time, thus preventing total or partial hydrolysis of the coordinating glucoside, and preventing any significant displacement of the aforesaid phosphate conversion equilibria, with consequent total or partial blocking of the system. The new compositions according to the invention therefore act both by attacking the iron oxides which may be present on the steel surface, and by forming a protective surface layer of organometallic chelate.

The final protective layer is constituted mainly by the organic coordination layer. However, in this case there is not the preoccupation regarding an absolutely continuous layer, in that any discontinuous zones are protected by the underlying phosphate layer constituted by Me, Fe and Fe/Me tertiary phosphates in various proportions.

In addition to said components, which are essential for the operation of the antirust system, the new compositions according to the invention comprise a certain number of components which do not take part in the formation of the protective layer, but allow the system to operate at its best.

These components are:

(a) Formaldehyde, which accelerates the formation of the protective layer, and is insensitive to the oxidising action of the nitrate present. In the presence of formaldehyde the reaction is complete and the layer stable in a maximum time of 24 hours (b) One or more water-miscible organic solvents chosen from the group consisting of linear or branched aliphatic alcohols of 1–4 carbon atoms, and glycols and polyglycols having a molecular weight not exceeding 600. The purpose of this organic solvent fraction which dissolves the chelating glucosides but not the inorganic salts is to "preserve" the glucosides from prolonged contact with phosphoric acid during the storage of the compositions. Because of their perfect and complete miscibility with water, during the operational stage they in no way hinder the formation of a perfectly homogeneous system which can be applied uniformly. Moreover, the organic solvents remove heterogeneous substances such as grease, oil, workshop dust and the like from the surface, provided they are present in limited quantity.

The previously listed components are present in the new compositions in quantities lying within the critical limits given hereinafter. The percentages are percentages by weight of the total weight of the composition, including organic solvents and water:

The pyrogallic acid glucosides and/or ellagic acid glucosides are present in the composition in a quantity of between 15 and 30%. Quantities less than 15% lead to an incoherent final layer, while quantities exceeding 30% make the stability of the composition in solution critical.

Particularly important is the discovered fact that it is not necessary to use the said glucosides in their pure state, but instead natural tannin extracts can be advantageously used, provided they consist mainly (more than 70%) of glucosides having a molecular weight of between 270 and 1200.

The remainder of these extracts is constituted essentially of polysaccharides and small quantities of polyphenols. These natural extracts are inexpensive and thus do not strongly affect the cost of the final product.

The phosphoric acid is present in the composition in a quantity of between 2 and 3.2%. The quantity of $Me(H_2PO_4)_2$ is between 1.1 and 2%, and the quantity of nitrate (of Zn or Mn) varies between 7 and 12%.

The result of a defect in one of these components in the composition is a lower rate of initial attack, and an incoherent final protective layer. An excess of one or more of said components excessively slows down the various processes which compete in the formation of the protective layer, and thus leads to an overall slowing down in the formation of the protective layer on the treated surface.

The formaldehyde is contained in the compositions in a quantity of between 0.5 and 1%.

The minimum limit indicated corresponds to the minimum necessary for acting as an accelerator for the layer formation process. A quantity exceeding 1% serves no purpose, and in fact is damaging in that it begins to interfere.

The organic solvent as heretofore defined is in practice always a mixture of solvents, in which each component has a specific function.

In general, it is a mixture consisting of a lower alcohol with the main purpose of degreasing the metal surface, one or more slowly evaporating glycols which slow down the drying of the layer and thus aid uniformity, and a mixture of cellosolves which have a high solvent power for the glucosides and thus "preserve" them whithin certain limits from the acid aqueous phase. In total, the organic solvent fraction constitutes 18 to 32% of the compositions. The composition comprising the aforesaid components in the percentages indicated is diluted with water to 100%. A homogeneous solution is then obtained.

The compositions according to the present invention can be prepared in various ways, all equally suitable for the purpose.

The following sequence of stages, which has been carried out with positive results, is given by way of example:

1. Preparation of a pre-mixture consisting of a solution of the phosphoric acid, the metal phosphate and nitrate in water
2. Addition of the organic fraction, under stirring, to the uniform prepared pre-mixture
3. Dilution of the obtained aqueous solution with the organic solvents, followed by addition of the additives and of the water necessary for bringing it up to the required volume.

For example, stage 1 was carried out by preparing a pre-mixture of the following components

| | |
|---|---|
| $H_3PO_4$ | 10% |
| $Zn(H_2PO_4)_2$ | 6% |
| $Zn(NO_3)_2$ | 36% |
| $H_2O$ | 48% |

To this pre-mixture, which was prepared by simply stirring the components at ambient temperature, was added a natural tannin extract of pH 3.10 having the following composition:

| | |
|---|---|
| pyrogallic acid glucosides and ellagic acid glucosides | 75.70% |
| polysaccharides and polyphenols | 14.90% |
| insolubles | 0.20% |
| water | 9.20% |

The glucosides have an average molecular weight of about 1000. Isopropanol, monoethylene glycol, butylcellosolve, cellosolve, formaldehyde and water were added to the solution obtained, in order to give a final composition of the following proportions:

| | |
|---|---|
| pre-mixture | 25.5% |
| tannin extract | 22.3% |
| $CH_2O$ | 2.0% |
| isopropanol | 10.5% |
| glycol | 10.5% |
| butylcellosolve | 2.5% |
| cellosolve | 2.5% |
| water | 24.2% |

The compositions in solution according to the present invention can be applied to steel surfaces by any method of the known art, for example by spraying, by immersion or manually.

This makes it possible to use the new antirust process for any type of article whether large, such as ships in shipyards, gas holders, tanks, reaction columns and the like, or small such as automobile body pieces.

The compositions are applied at ambient temperature, preferably between 15° and 30° C., in layers having a thickness depending on the surface state of the steel.

In general, layers of 3–5 microns are sufficient. Under normal conditions, drying is complete and the protective layer stable within 24 hours. However, it is preferable to wait at least 48 hours before applying any further layers.

The mixed organic-inorganic antirust layers obtained by the present invention have been found compatible with any finishing layer applied to then, and in particular with any type of paint. They ensure electrical insulation of the metal surfaces, perfect anchoring of the subsequent finishing layers and in particular paint, and a large increase in corrosion resistance of the article, to an extent never attained up to the present time.

In order to demonstrate the great technical progress made in the field of anticorrosive coatings by the new compositions, a certain number of comparative tests have been carried out to correlate the type of preventive treatment of metal surfaces before covering with large thickness paint layers, with the applicational behaviour of the painted metal parts.

The examinations have been carried out using conventional investigation methods for the finishing layers, together with other specific tests for the large thickness coatings, such as the tendency to form blisters from residual salt.

The accompanying drawings show the results obtained in the various tests according to the pretreatment. More precisely, each drawing figure comprises three curves, one of which relates to the steel surface either as such or sand-blasted, one relates to the name surface phosphated with a known commercial phosphating agent (Gabrol $C_2$ of Italbonder of Milan), and a third relates to the same steel surface but pretreated with an antioxidant according to the present invention, in particular of the composition indicated heretofore.

In all cases, the test pieces were covered with a paint layer using a naval painting cycle. The dimensions of the steel test pieces were 10.5 cm.×19.5 cm.

As can be seen from the drawings, the phosphating treatment clearly improves corrosion resistance of the steel, but the results obtained with the new treatment according to the invention are much better. A summary is given hereinafter of the essential characteristics of the tests shown in each drawing figure.

In FIGS. 3, 3A, 4, 4A, the abscissa represents the Schüster-Krause reading.

FIG. 1:
(a) Corrosion chamber resistance test in accordance with ASTM B 117-64
(b) Rust penetration on incision
(c) Treatment:1—plates as such, 2—plates+phosphoric antioxidant, 3—plates+new antioxidant,
(d) Naval painting cycle.

Figure 1A:
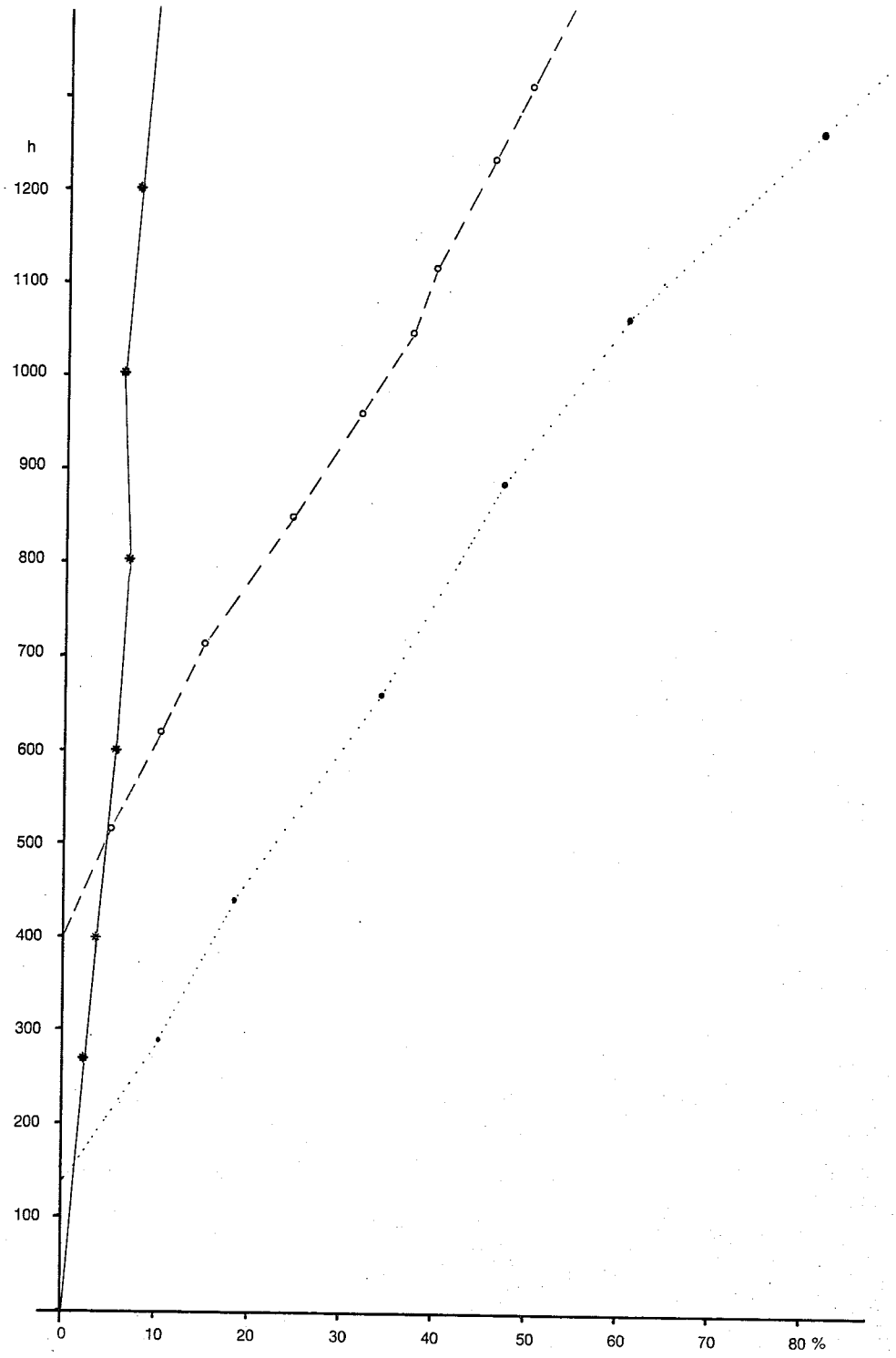

FIG. 1A:
(a) Ditto,
(b) Percentage blistering,
(c) Ditto,
(d) Ditto.

Figure 2:
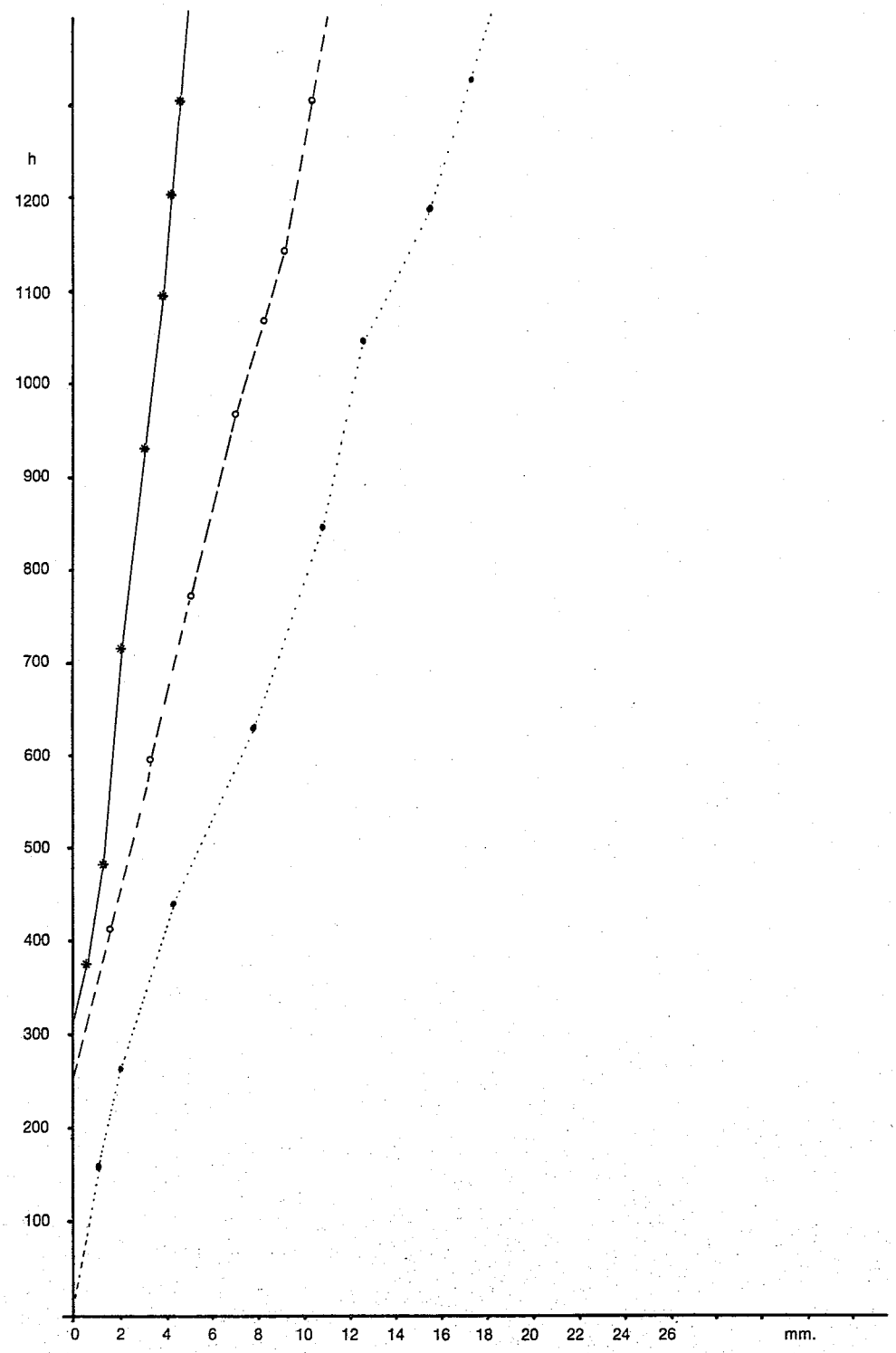

FIG. 2:
(a) Ditto,
(b) Rust penetration on incision,
(c) Treatment: 1—sand-blasted plates, 2—plates+-phosphoric antioxidant, 3–plates+new antioxidant
(d) External exposure for 48 hours+naval painting cycle.

Figure 2A:
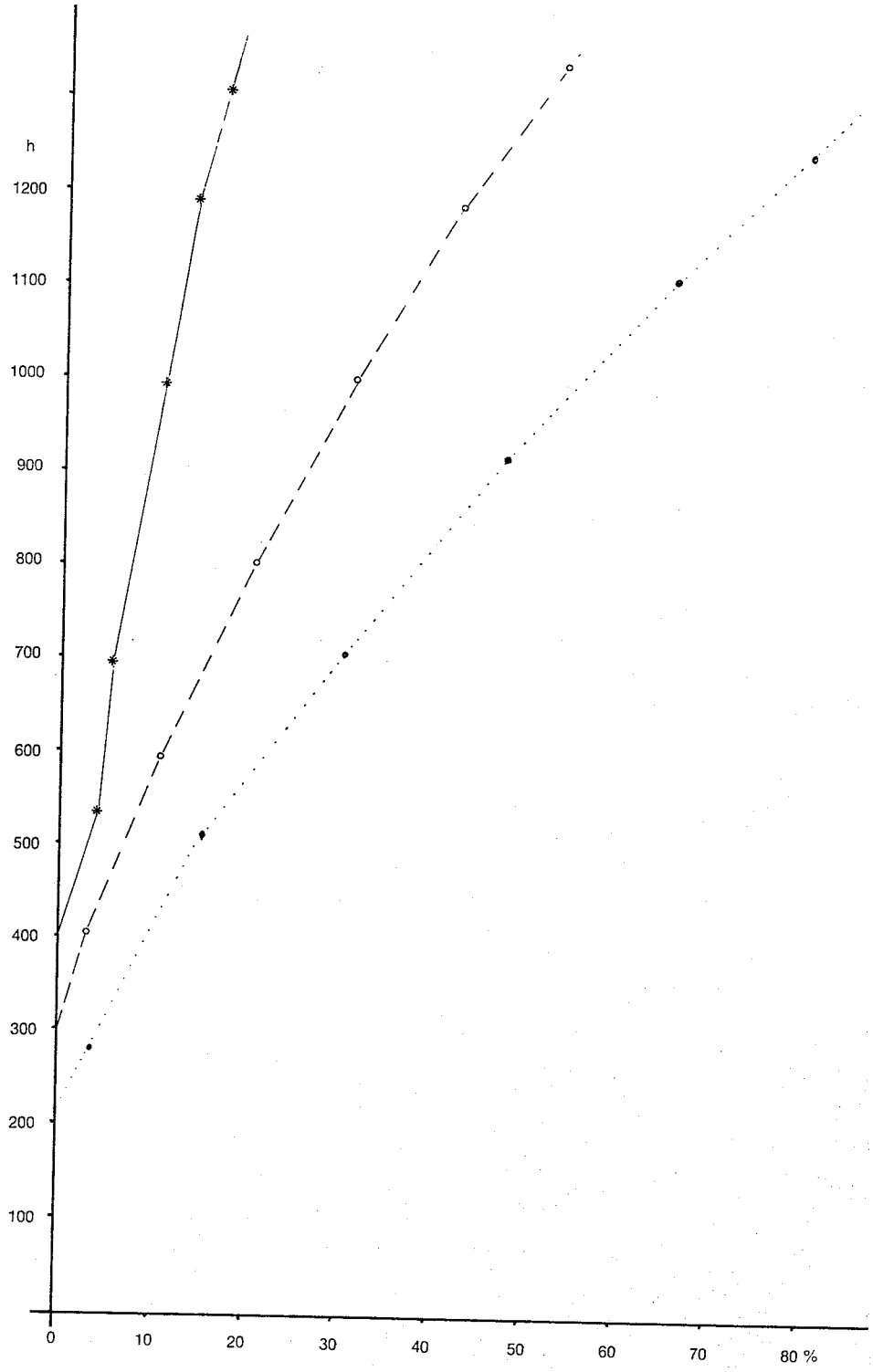

FIG. 2A:
(a) Ditto,
(b) Percentage blistering,
(c) Ditto,
(d) Ditto.

Figure 3:
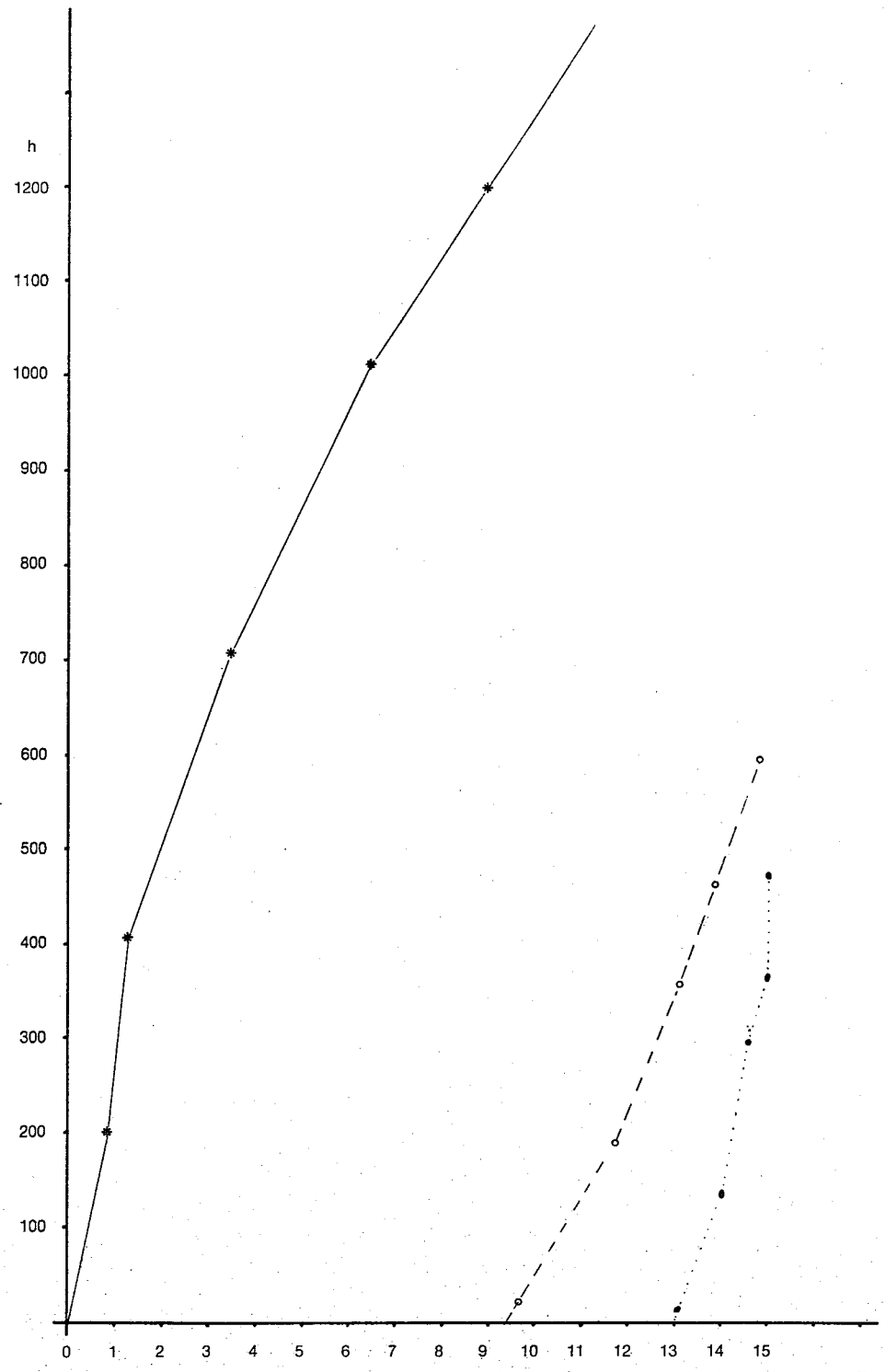

FIG. 3:
(a) Industrial external environment corrosion test
(c) Treatment: 1-plates as such, 2-plates+phosphoric antioxidant, 3-plates+new antioxidant,
(d) Naval painting cycle.

Figure 3A:
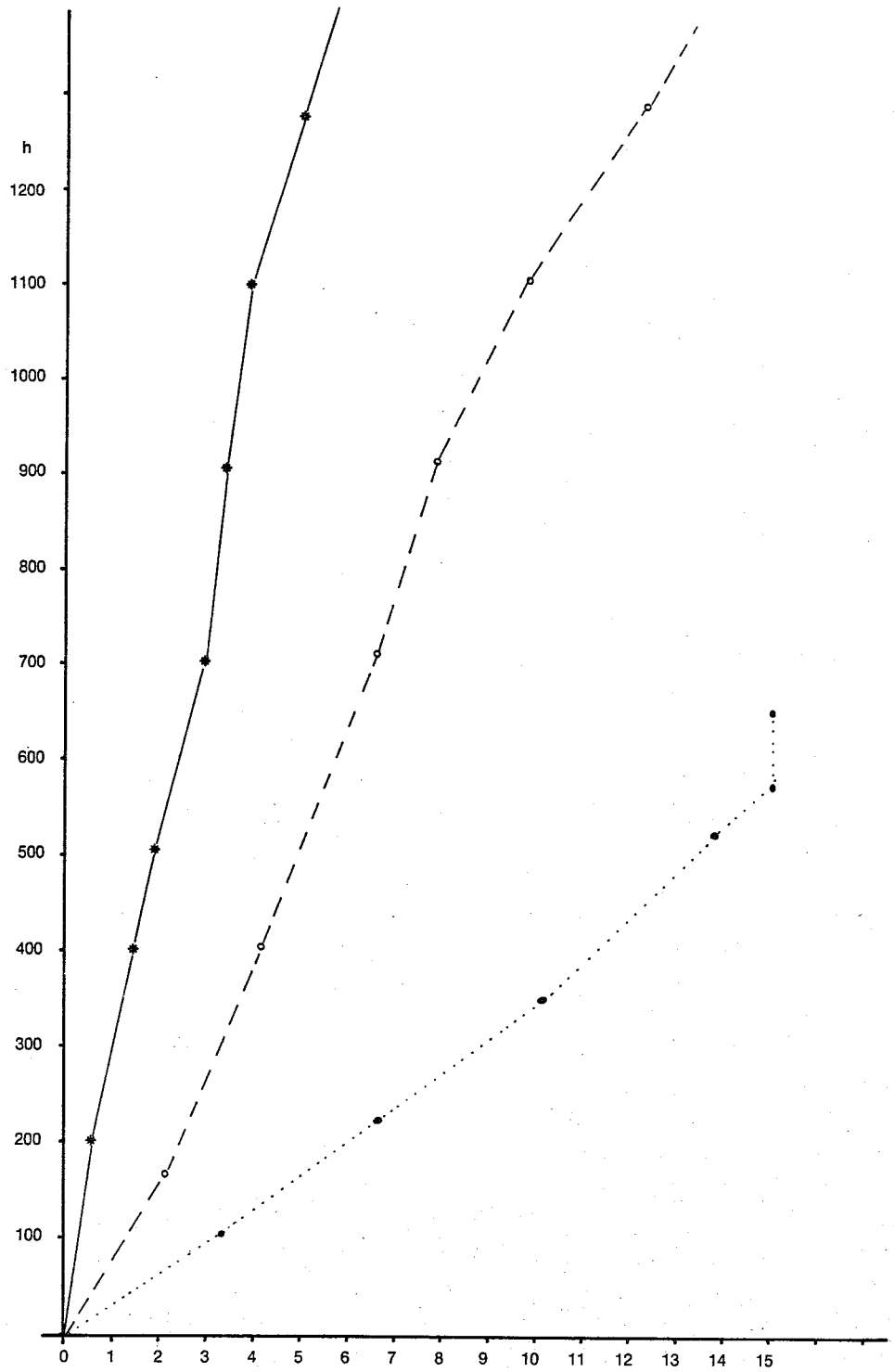

FIG. 3A:
(a) Ditto,
(c) Treatment: 1—sand-blasted plates, 2—plates+-phosphoric antioxidant, 3—plates+new antioxidant,
(d) External exposure for 48 hours+navel painting cycle.

Figure 4:
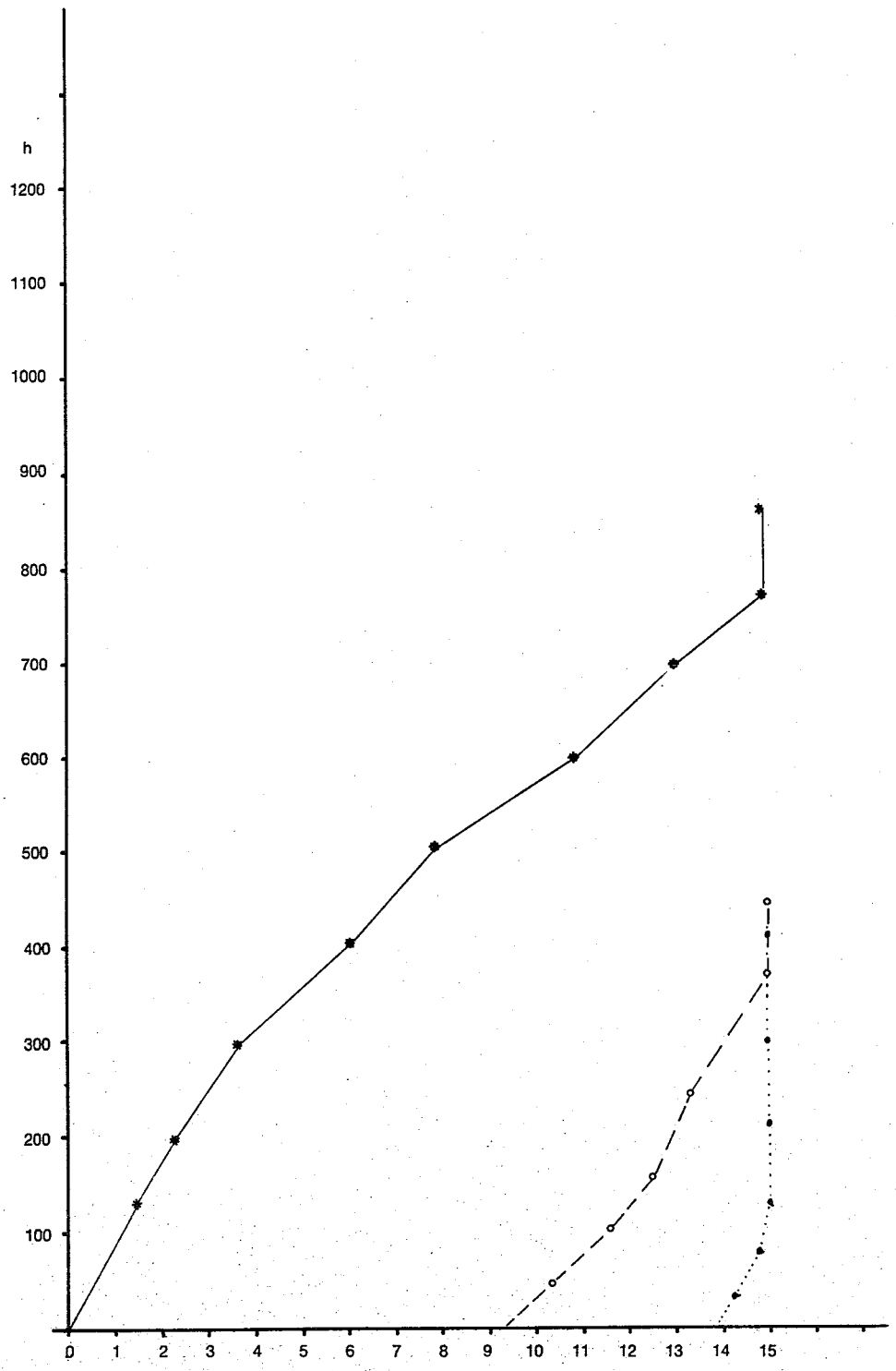

FIG. 4:
(a) Corrosion chamber resistance test in accordance with ASTM B 117-64,
(c) Treatment: 1—plates as such, 2—plates+phosphoric antioxidant, 3—plates+new antioxidant,
(d) Naval painting cycle.

Figure 4A:
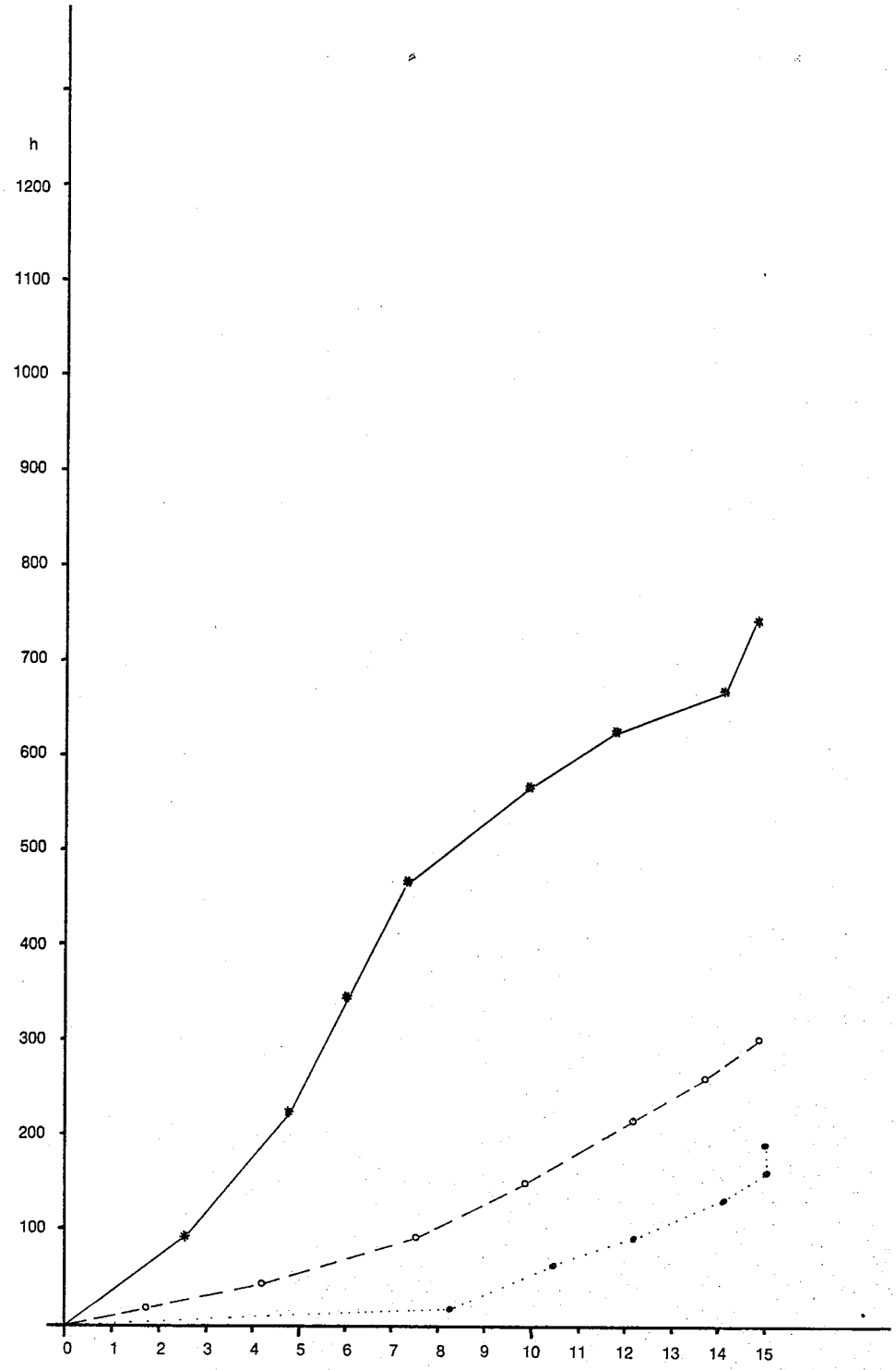

FIG. 4A:
(a) Ditto,
(c) Treatment: 1—sand-blasted plates, 2—plates+-phosphoric antioxidant, 3—plates+new antioxidant
(d) External exposure for 48 hours+naval painting cycle.

* Pretreatment with new antioxidant,
o - - - - - Pretreatment with GABROL C2,
o . . . . . AS SUCH.

What we claim is:

1. A composition for protecting steel surfaces from the oxidizing action of the atmosphere, comprising as essential actial components:
an acid of molecular weight between 270 and 1200 selected from the group consisting of pyrogallyc acid glucosides, ellagic acid glucosides and combinations thereof in a quantity between about 15 and about 30%
phosphoric acid in a quantity between about 2 and about 3.2% by weight;
a phosphate selected from the group consisting of zinc phosphate, manganese phosphate and combinations thereof in a quantity between about 1.1 and about 2% by weight; and
a nitrate selected from the group consisting of zinc nitrate, manganese nitrate and combinations thereof in a quantity between about 0.5 and about 1% by weight.

2. A composition as recited in claim 1, further comprising as auxiliary components formaldehyde in a quantity of between about 0.5 and about 1% by weight, and hydroxylated organic solvents miscible with water in a total quantity of between about 18 and about 32% by weight.

3. A composition as recited in claim 2, wherein the hydroxylated organic solvents are selected from the group consisting of linear or branched aliphatic alcohols of 1 to 4 carbon atoms, and glycols or polyglycols of molecular weight not exceeding 600.

4. A composition as recited in claim 1, wherein the pyrogallic acid glucosides, ellagic acid glucosides or combinations thereof are present in the form of natural tannin extract contained therein in a quantity exceeding 70%.

5. A method for protecting steel surfaces from the oxidizing action of the atmosphere, wherein a protective composition comprising the following essential components is applied directly to the oxidized or unoxidized steel surfaces:
an acid of molecular weight between 270 and 1200 selected from the group consisting of pyrogallic acid glucosides, ellagic acid glucosides and combinations thereof in a quantity between about 15 and about 30% by weight;
phosphoric acid in a quantity between about 2 and about 3.2% by weight;
a phosphate selected from the group consisting of zinc phosphate, manganese phosphate and combinations thereof in a quantity between about 1.1 and about 2% by weight; and
a nitrate selected from the group consisting of zince nitrate, manganese nitrate and combinations thereof in a quantity of between about 0.5 and 1% by weight.

6. A method as recited in claim 5, wherein the applied protective composition further includes formaledhyde in a quantity of about 0.5 to about 1% by weight and hydroxylated organic solvents miscible with water in a quantity of about 18 to about 32% by weight.

7. A steel article, comprising, either as an intermediate protective layer or as a final outer protective layer, a phosphated-chelated layer obtained by applying the composition as recited in claims 1, 2, 3 or 4.

* * * * *